United States Patent [19]

Kouchi et al.

[11] 4,265,992

[45] May 5, 1981

[54] COATED MAGNETIC DEVELOPER PARTICLES FOR ELECTROPHOTOGRAPHY CONTAINING VINYL AND OLEFIN RESINS

[75] Inventors: Toshihiro Kouchi, Hirakata; Hiroshi Takayama; Tatsuo Aizawa, both of Osaka, all of Japan

[73] Assignee: Mita Industrial Company Limited, Osaka, Japan

[21] Appl. No.: 929,411

[22] Filed: Jul. 31, 1978

[30] Foreign Application Priority Data

Aug. 5, 1977 [JP] Japan ..... 52/93361

[51] Int. Cl.[3] ..... G03G 9/14

[52] U.S. Cl. ..... 430/107; 430/109; 430/137

[58] Field of Search ..... 252/62.1 P, 62.1 M; 430/107, 137, 109

[56] References Cited

U.S. PATENT DOCUMENTS

| | | | |
|---|---|---|---|
| 3,196,032 | 7/1965 | Seymour | 430/137 |
| 3,239,465 | 3/1966 | Rhemfrank | 252/62.1 PM |
| 3,558,492 | 1/1971 | Proskow | 252/62.1 P |
| 3,639,245 | 2/1972 | Nelson | 430/109 |
| 3,645,770 | 2/1972 | Flint | 252/62.1 PM |
| 3,933,665 | 1/1976 | Van England | 252/62.1 P |
| 4,022,738 | 5/1977 | Shimada et al. | 260/28 P X |

*Primary Examiner*—John D. Welsh

*Attorney, Agent, or Firm*—Sherman & Shalloway

[57] ABSTRACT

In a one-component type developer for electrophotography consisting essentially of a dry blend of fixing magneto-sensitive particles and flowability- and electric resistance-controlling fine particles, when an aromatic vinyl resin and/or an acrylic resin is used as a binder resin for the magneto-sensitive particles in combination with a low molecular weight olefin resin, the magneto-sensitive particles are much improved in the property of holding the flowability- and electric resistance-controlling fine particles on the surfaces thereof. Accordingly, these fine particles cannot be substantially separated from the magneto-sensitive particles under agitation conditions, development conditions and fixing conditions. As a result, contamination of the interior of a copying machine, especially an optical system, can be completely prevented, and also contamination of the background can be completely prevented. Further, the resulting fixed images have a very high resistance to friction and abrasion, and troubles such as blurring and flow of the image are not caused at all.

14 Claims, No Drawings

COATED MAGNETIC DEVELOPER PARTICLES FOR ELECTROPHOTOGRAPHY CONTAINING VINYL AND OLEFIN RESINS

BACKGROUND OF THE INVENTION (1) Field of the Invention

The present invention relates to a one-component type developer for electrophotography. More particularly, the invention relates to an electrically conductive magnetic developer capable of development without the use of a magnetic carrier, in which fixing and electric resistance-controlling fine particles are tightly held on the surfaces of fixing magneto-sensitive particles in the substantially non-embedded state, whereby low electric resistance and good flowability, desireable for the development operation, can be maintained and contamination of the background or parts of a copying machine with the above-mentioned fine particles separated from the surfaces of the fixing magneto-sensitive particles can be drastically diminished.

(2) Description of the Prior Art

As one of methods for developing electrostatic latent images formed by electrophotography, there has heretofore been broadly adopted a so-called magnetic brush method. According to the basic magnetic brush method, toner particles comprising a pigment and a resin imparting a fixing property and desirable electric characteristics to the pigment are mixed with a magnetic carrier such as iron powder to form a developer, and an electrostatic latent image-carrying surface of a support is tightly contacted with magnetic brushes composed of this developer to visualize the latent image with the toner particles. In this method using such mixture of a toner and a magnetic carrier, only the toner particles are consumed by the development operation and the mixing ratio of the toner to the magnetic carrier is changed. Accordingly, there must be conducted a troublesome operation of supplying the toner into a developing mechanism to maintain a predetermined mixing ratio between the toner and magnetic carrier.

A so-called magnetic developer as disclosed in the specification of U.S. Pat. No. 3,639,245 or Japanese Patent Application Laid-Open Specification No. 20729/75 is known as a developer capable of development with a toner alone without the use of a particular carrier. A customarily used magnetic developer of this type is ordinarily formed by dispersing a powder of a magnetic material such as triiron tetroxide, optionally with other pigment, into a binder resin medium, forming the resulting composition into particles and embedding an electrically conductive substance such as carbon black into the surfaces of the particles to impart to the entire particles a property of being magnetically attracted and to render the surfaces of the particles electrically conductive.

This magnetic developer has an advantage that a clear and sharp image with reduced edge effects can be obtained according to the magnetic brush development method without using a magnetic carrier or the like. However, preparation of this magnetic developer involves various defects and difficulties.

Further, such known magnetic developers are still insufficient with respect to the flowability of developer particles, and because of this insufficient flowability, various troubles are caused at the developing step. More specifically, since the known magnetic developer has not a flowability sufficient to apply the developer uniformly onto a developing roller (sleeve), for example, masses of the developer are formed on the surface of the sleeve and the background is often contaminated when such masses of the developer particles fall down on a copying sheet or the like. Further, blurred images are readily formed because of non-uniform adhesion of the developer particles to the sleeve surface.

As means for improving the flowability of particles of a magnetic developer, there is known a method in which finely divided silica is incorporated as a lubricating agent in the magnetic developer particles. Since the electric resistance of the silica powder adhering around the particles of the electrically conductive magnetic developer is relatively high, the electric resistance of the developer as a whole is increased and such defects as blurring of image contours are caused.

We previously found that when a composition formed by dispersing a powder of magnetic material such as triiron tetroxide, optionally with other pigment, into a binder resin medium is shaped into spherical particles having fine convexities and concavities on the surface thereof or having a crater-like rough surface and such spherical particles are dry-blended with flowability- and electric resistance-controlling fine particles composed of carbon black or the like to form a developer, said fine particles are held on the surfaces of the spherical particles and low electric resistance and high flowability, desirable for the developing operation, can be attained in the resulting developer, and that although said fine particles are present on the surfaces of spherical particles in the non-embedded state, isolation of the fine particles from the surfaces of the spherical particles is substantially prevented and contamination of the background is not substantially caused. Based on this finding, we proposed this excellent developer (see Japanese Patent Application Laid-Open Specification No. 88277/76) corresponding to U.S. Application Ser. No. 732,759.

However, in our previously proposed developer, fine particles such as of carbon black are not completely fixed to the surfaces of fixing magneto-sensitive spherical particles. Accordingly, if the dry blending of both the particles is completed in a short time, a large quantity of carbon black is incorporated so as to reduce the electric resistance or if the number of convexities and concavities on the surfaces of the magneto-sensitive particles is small, at the step of agitating the developer in a developer tank or the step of the magnetic brush development, carbon black is often isolated from the surfaces of fixing magneto-sensitive particles and scattered to contaminate an optical system of a copying machine or the background of a copying sheet. This isolation of carbon black particles is especially conspicuous when fixing magneto-sensitive particles are those prepared by kneading a fine powder of a magnetic material with a melt of a resin binder, pulverizing the mixture under cooling and classifying the resulting particles by sieving. In this case, the fixing magneto-sensitive particles have none of convexities or concavities on the surfaces thereof or if they have, the number of convexities and concavities is very small. Further, since the fine powder of the magnetic material is covered and wrapped with the binder resin, the fixing magneto-sensitive particles have a relatively high electric resistance. Therefore, these particles should be dry-blended with a large quantity of carbon black. For these reasons, isolation of carbon black becomes especially conspicuous in case of the above-mentioned fixing magneto-sensitive particles.

In the above-mentioned one-component type developer formed by dry-blending fixing magneto-sensitive particles with carbon black, as the mixing ratio of carbon black increases, the tendency that carbon black particles separate from a fixed image when the fixed image is rubbed with a finger or the like becomes conspicuous and the fixed image is readily blurred. In short, this one-component type developer is still insufficient in the friction resistance of a fixed image.

BRIEF SUMMARY OF THE INVENTION

Independently from the conventional concept that when fine convexities and concavities are formed on the surfaces of fixing magneto-sensitive particles formed by dispersing a fine powder of a magnetic material into a binder resin medium or crater-like rough surfaces are given to these fixing magneto-sensitive particles, flowability- and electric resistance-controlling fine particles such as those of carbon black can be held on the surfaces of these fixing magneto-sensitive particles, we recently found that when an aromatic vinyl resin and/or an acrylic resin is used in combination with a low-molecular-weight olefin resin as a binder medium in which a fine powder of a magnetic material is to be dispersed, the resulting fixing magneto-sensitive particles have a property of tightly holding flowability- and electric resistance-controlling fine particles such as those of carbon black on the surfaces thereof and the foregoing defects can be effectively eliminated.

It is therefore a primary object of the present invention to provide a one-component type, namely carrierless, developer for electrophotography in which although flowability- and electric resistance-controlling fine particles such as those of carbon black are held in the non-embedded state on the surfaces of fixing magneto-sensitive particles, these fine particles are not isolated under agitation conditions, development conditions and fixing conditions.

Another object of the present invention is to provide a one-component type developer for electrophotography which has in combination a high flowability, a low electric resistance, no tendency of contamination of the background and a high friction resistance of a fixed image.

Still another object of the present invention is to provide a one-component type developer for electrophotography which is excellent in the adaptability to the development operation and the adaptability to the fixing operation.

A further object of the present invention is to provide a one-component type developer for electrophotography which can be manufactured very simply at a relatively low manufacturing cost.

In accordance with the present invention, there is provided a one-component type developer for electrophotography consisting essentially of a dry-blend of fixing magneto-sensitive particles (hereinafter often referred to as "magneto-sensitive particles") having a particle size of 5 to 50$\mu$ and flowability- and electric resistance-controlling fine particles (hereinafter often referred to as "fine particles") having a particle size of up to 1$\mu$ in an amount of 0.001 to 2 parts by weight per 100 parts by weight of said fixing magneto-sensitive particles, wherein said fixing magneto-sensitive particles are composed of a kneaded composition comprising (A) $Fe_3O_4$ or $\gamma$-$Fe_2O_3$, (B) carbon black, (C) a binder resin composed mainly of at least one resin selected from the group consisting of aromatic vinyl resins and acrylic resins and (D) a low-molecular-weight olefin resin at an (A):(B):(C):(D) mixing weight ratio of (20–80):(0.5–20):(18–40):(0.5–30), and said flowability- and electric resistance-controlling fine particles are adhering to and held on the surfaces of said fixing magneto-sensitive particles substantially inseparably therefrom.

DETAILED DESCRIPTION OF THE PREFERRED EMBODIMENTS

In the developer of the present invention, the flowability- and electric resistance-controlling fine particles are adhering to and held on the fixing magneto-sensitive particles inseparably therefrom under agitation conditions, development conditions and fixing conditions. This can easily be confirmed by examining contamination of an optical system after the developer has been actually used for a certain period of time at a copying test using a practical electrophotographic copying machine, examining the background of a developed copying sheet and testing the friction resistance of fixed image, as specifically illustrated in Examples given hereinafter.

In the present invention, in order to hold fine particles of carbon black or the like on the surfaces of the magneto-sensitive particles inseparably therefrom even under friction conditions, it is very important that a combination of an aromatic vinyl resin and/or an acrylic resin with a low-molecular-weight olefin resin should be used as a binder medium for dispersion of a fine powder of a magnetic material.

For example, as illustrated in Comparative Example 1 given hereinafter, when an aromatic vinyl resin and/or an acrylic resin alone is used as the binder medium and fixing magneto-sensitive particles are prepared by kneading, cooling, pulverization and classification, if a relatively large amount of carbon black is dry-blended into the resulting magneto-sensitive particles, blended carbon black is separated from the magneto-sensitive particles, causing contamination of an optical system of a copying machine, contamination of the background of a copy sheet and reduction of the friction resistance of a fixed image (bleeding or blurring in a fixed image).

In contrast, when an aromatic vinyl resin and/or an acrylic resin and a low-molecular-weight olefin resin are used in combination as the binder medium according to the present invention and magneto-sensitive particles are prepared by kneading, cooling, pulverization and classification, even if a relatively large amount of carbon black is dry-blended therein, fine particles of carbon black are not separated from the magneto-sensitive particles and contamination of an optical system of a copying machine or contamination of the background of a copy sheet is not caused at all, and the resulting fixed image is especially excellent in the friction resistance. This fact will be apparent from Examples given hereinafter.

A two-component type developing toner comprising a pigment, a styrene type resin and a low-molecular-weight olefin resin is known in the art, and it is known that when such two-component type developer is used, by virtue of the specific action of the low-molecular-weight olefin resin, heat fixation using a heating roller is made possible without using an offset-preventing liquid (see Japanese Patent Application Laid-Open Specification No. 65231/74). The low-molecular-weight olefin resin to be included in the magneto-sensitive particles in the present invention has a function of holding the dry-blended fine particles on the surfaces of the magneto-sensitive particles inseparably therefrom. Therefore, the property or function of the low-molecular-weight olefin resin utilized in the present invention is unobvious over such known fact.

The reason why the low-molecular-weight olefin resin included in the magneto-sensitive particles has a function of holding fine particles of carbon black or the like inseparably in the present invention has not been completely elucidated. In the one-component type developer of the present invention, the fine particles are adhering to and held on the surfaces of the magneto-sensitive particles in the non-embedded state. As the force capable of attaining such adhesion of the fine particles to the magneto-sensitive particles, there can be considered an electrostatic force (Coulomb force) and van der Waals force. Therefore, it is considered that the low-molecular-weight olefin resin has a function of promoting or enhancing one or both of these two forces. This consideration coincides well with the fact that a low-molecular-weight olefin resin has excellent electric characteristics such as high electric resistance, high dielectric constant and high chargeability and with the fact that a low-molecular-weight olefin resin has a relatively high affinity with carbon black.

In the present invention, it is important that a binder resin composed mainly of at least one member selected from the group consisting of aromatic vinyl resins and acrylic resins should be chosen among various binder resins and used for dispersion of a fine powder of a magnetic material such as triiron tetroxide. When such binder resin is used in combination with a low-molecular-weight olefin resin, it exerts an excellent function of holding the dry-blended fine particles inseparably.

As the aromatic vinyl resin, there can be used homopolymers and copolymers of monomer represented by the following general formula:

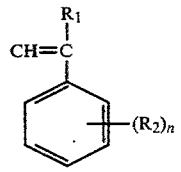

wherein $R_1$ stands for a hydrogen atom or a lower alkyl group (by the term "lower" used herein is meant "having up to 4 carbon atoms"), $R_2$ stands for a lower alkyl group, a lower alkoxy group, a nitro group, an amino group, a halogen atom or other substituent, and n is 0 or an integer of 1 or 2, such as styrene, α-methylstyrene, vinyltoluenes (o-, m- and p-methylstyrenes), o-, m- and p-ethylstyrenes, tert-butylstyrene, cyclohexylstyrene, phenylstyrene, methoxystyrene, chlorostyrene, nitrostyrene and aminostyrene. Further, copolymers of these monomers with other ethylenically unsaturated monomers can be used in the present invention.

As such ethylenically unsaturated monomer copolymerizable with the aromatic vinyl monomer, there can be mentioned, for example, vinyl esters such as vinyl acetate, vinyl formate and vinyl propionate, ethylenically unsaturated carboxylic acids such as arylic acid, methacrylic acid, maleic anhydride, fumaric acid, crotonic acid and itaconic acid, esters thereof such as ethyl acrylate, methyl methacrylate, 2-ethylhexyl acrylate and 3-hydroxyethyl acrylate, amides thereof such as acrylamide and methacrylamide, ethylenically unsaturated nitriles such as acrylonitrile and methacrylonitrile, N-vinyl compounds such as N-vinylpyrrolidone, N-vinylindole and N-vinylcarbazole, vinyl ethers such as vinylmethyl ether and vinylisobutyl ether, vinyl ketones such as vinylmethyl ketone and vinylhexyl ketone, olefins such as ethylene, propylene and 4-methylpentene, and diolefins such as butadiene and isoprene.

The aromatic vinyl copolymer may be a so-called random, block or graft copolymer. Copolymers that are preferably used in the present invention are styrene/butadiene copolymers, vinyltoluene/butadiene copolymers, styrene/acrylic acid ester copolymers, vinyltoluene/acrylic acid ester copolymers, styrene/acrylic acid ester/butadiene copolymers, vinyltoluene/acrylic acid ester/butadiene copolymers and styrene/ethylene copolymers.

In order to attain the objects of the present invention effectively, it is preferred that the aromatic vinyl resin that is used in the present invention should contain at least 15 mole %, especially at least 50 mole %, of aromatic vinyl units.

The acrylic resin that is used in the present invention includes homopolymers and copolymers of acrylic acid, acrylic acid esters, acrylamide, acrylonitrile, methacrylic acid and methacrylic acid esters. Preferred examples are homopolymers of acrylic acid esters, homopolymers of methacrylic acid esters, acrylic acid ester/methacrylic acid ester copolymers and acrylic acid ester/vinyl acetate copolymers.

In the present invention, the aromatic vinyl resin and the acrylic resin may be used singly or in combination. Further, if desired, other resin, for example, a polyvinyl acetal resin, an epoxy resin, a polyester resin, a phenolic resin or a petroleum resin may be incorporated in the aromatic vinyl resin and/or the acrylic resin in such an amount as will not substantially degrade or change inherent properties of the binder resin, for example, up to 50% by weight based on the total binder resin.

As the polyvinyl acetal resin, there can be used polymers obtained by acetalizing saponified polyvinyl acetate, such as polyvinyl butyral and polyvinyl formal.

As the epoxy resin, there can be used bis- and tris-epoxy compounds obtained by reacting a polyhydric phenol, polyhydric alcohol or resol type phenolic resin with an epihalohydrin. A typical epoxy resin is a bis-epoxy compound represented by the following formula:

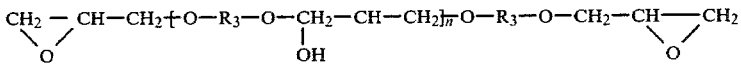

wherein $R_3$ stands for a residue of a dihydric phenol, especially a residue of bis-2,2-(4-hydroxyphenyl)propane. If desired, such epoxy resin may be used in combination with a reactive resin such as a polyvinyl acetal resin, a phenolic resin or an acrylic resin.

As the polyester resin, there can be used saturated polyester resins having a relatively low softening point, such as ethylene/butylene-terephthalate/isophthalate copolymers, ethylene/butylene-terephthalate/isophthalate/adipate copolymers, maleic acid resins, namely resins obtained from a rosin-maleic anhydride adduct and a polyhydric alcohol, and alkyd resins.

As the phenolic resin, there can be used resol type phenolic resins obtained by condensing a phenol such as phenol, o-, m- or p-cresol, bisphenol A, p-tert-butylphenol or p-phenylphenol with formaldehyde in the presence of an alkali catalyst, and resins obtained by modifying these phenolic resins with rosin or xylene resin.

It is preferred that the aromatic vinyl resin or acrylic resin that is used in the present invention should have a relatively low molecular weight, for example, a molecular weight of 500 to 75,000, especially 1,000 to 30,000.

As the low-molecular-weight olefin resin that is used in the present invention, there can be mentioned homopolymers and copolymers of monomers represented by the following formula:

$$CH_2{=}\underset{\underset{R_4}{|}}{CH}$$

wherein $R_4$ stands for an alkyl group having up to 4 carbon atoms or a hydrogen atom, such as ethylene, propylene, pentene-1 and 4-methylpentene-1, and modified resins of these homopolymers and copolymers. By the term "modified resin" used herein are meant resins obtained by oxidizing a polyolefin such as polyethylene, e.g., oxidized polyethylene, resins obtained by grafting a small amount of other ethylenically unsaturated monomer such as maleic anhydride, an acrylic acid ester or a methacrylic acid ester to a polyolefin, e.g., maleic acid-modified polypropylene and acrylic acid ester-grafted polyethylene, and other known modified polyolefins.

It is preferred that the weight average molecular weight of the low-molecular-weight olefin resin be in the range of about 1,000 to about 10,000 and that the softening point (as measured according to the ring-ball method) of the low-molecular-weight olefin resin be in the range of 80° to 160° C.

In the present invention, it is important that (A) $Fe_3O_4$ or $\gamma$-$F_2O_3$, (B) carbon black, (C) the binder resin and (D) the low-molecular-weight olefin resin should be contained in the fixing magneto-sensitive particles at an (A):(B):(C):(D) weight ratio of (20–80):(0.5–20):(18–40):(0.5–30), especially (40–75):(1–10):(20–35):(1–15).

When the amount of triiron tetroxide or $\gamma$-$Fe_2O_3$ is below the above range, it is difficult to conduct development satisfactorily without use of a magnetic carrier, and when the amount of triiron tetroxide or $\gamma$-$Fe_2O_3$ exceeds the above range, the fixing property is degraded. When the amount of carbon black in the magneto-sensitive particles is below the above range, a necessary electric conductivity cannot be obtained and blurring is caused in image contours, and when the amount of carbon black in the magneto-sensitive particles exceeds the above range, the fixing property is degraded. When the amounts of both the triiron tetroxide and carbon black exceed the above range, the mechanical strength of the magneto-sensitive particles is degraded and it becomes difficult to control the particle size within a certain range.

When the amount of the binder resin composed of the aromatic vinyl resin and/or the acrylic resin is below the above range, the fixing property or the mechanical strength of the particles is degraded, and when the amount of the binder resin exceeds the above range, no sufficient electric conductivity can be obtained, blurring is caused in image contours and the moldability (adaptability to pulverization to particles) is degraded. If the amount of the low-molecular-weight olefin is below the above range, it becomes difficult to hold dry-blended fine particles of carbon black or the like on the surfaces of the magneto-sensitive particles substantially inseparably therefrom under agitation conditions, development conditions and fixing conditions. When the amount of the fine particles exceeds the above range, agglomeration becomes conspicuous among the developer particles and scoop-up of the developer particles to a sleeve becomes difficult, and the adaptability to the development operation is reduced.

Known additives or modifiers may be added according to known recipes to the magneto-sensitive particles to be used in the present invention, if desired. For example, pigment dispersants such as fatty acid metal soaps, resin acid soaps, napthenic acid metal salts and known surface active agents, and dyes such as Oil Black, Oil Blue, Nigrosine and Spilon Black may be incorporated.

The magneto-sensitive particles that are used in the present invention can be prepared by kneading a composition comprising triiron tetroxide, carbon black, the binder resin and the low-molecular-weight olefin resin at the above-mentioned weight ratio at a temperature higher than the melting points of the binder resin and the low-molecular-weight olefin resin and shaping the kneaded composition into particles.

In general, the low-molecular-weight olefin resin has no compatibility with the aromatic vinyl resin and/or the acrylic resin. Accordingly, at the above-mentioned kneading operation, it is preferred that the kneading conditions be chosen so that the aromatic vinyl resin and/or the acrylic resin forms a continuous phase and the low-molecular-weight olefin resin forms a dispersed phase as well as triiron tetroxide and carbon black.

We found that when the binder resin is first melt-kneaded with triiron tetroxide and carbon black and the low-molecular-weight olefin resin is then mixed and kneaded with the kneaded composition, the low-molecular-weight olefin resin is dispersed in good condition while forming a dispersed phase and there can be obtained a developer excellent in various properties such as fixing property, offset resistance, easy flow characteristic and low electric resistance. It is construed that the reason will probably be that the low-molecular-weight olefin resin has a relatively good affinity with triiron tetroxide, $\gamma$-$Fe_2O_3$ or carbon black and it is dispersed in the matrix of the binder resin in the form entrained by particles of triiron tetroxide or carbon black.

The kneading operation can be carried out according to known methods and accomplished by known means, so far as the above-mentioned requirement is satisfied. For example, a hot roll, a mixer and a kneader can be used as the kneading means. The kneading conditions are not particularly critical. In general, the kneading temperature and time are selected within a range of 100° to 220° C., especially 110° to 170° C., and a range of 2 to 30 minutes, especially 3 to 20 minutes, so that a homogeneous molten dispersion system can be formed and substantial thermal decomposition of the resins and the like is not caused.

Developer particles can be prepared from this kneaded composition by cooling the kneaded composition to room temperature or a lower temperature, pulverizing the cooled composition by a jet mill, a ball mill, a roll mill or a vibrating mill and, if desired, classifying the resulting particles by a sieve.

Developer particles can also be prepared by agitating the respective components in a high speed agitator such as a super mixer under such conditions that friction heat is generated to melt or soften the binder resin and the low-molecular-weight olefin. Even when this method is adopted instead of the above-mentioned heat-kneading method, integrated developer particles can be obtained.

Instead of pulverization of the cooled composition, there may be adopted direct spray granulation and centrifugal granulation of the molten mixture of the respective components. Also in this case, the magneto-sensitive particles of the present invention can be prepared.

In general, it is preferred that the number average particle size of the magneto-sensitive particles to be used for the developer of the present invention be 2 to 80μ, especially 5 to 50μ, though the preferred particle size differs to some extent depending on the preparation method. It is especially preferred that the particle size distribution of the magneto-sensitive particles be such that particles having a size larger than 50μ occupy less than 20% of the total particles and particles having a size smaller than 5μ occupy less than 15% of the total particles. In general, the magneto-sensitive particles have an as-pulverized shape (amorphous shape), but if desired, it is possible to obtain substantially spherical particles by passing such amorphous particles through hot air.

According to the present invention, the above-mentioned fixing magneto-sensitive particles are dry-blended with flowability- and electric resistance-controlling fine particles, whereby the fine particles are allowed to adhere uniformly in the non-embedded state to the surfaces of the magneto-sensitive particles. As such fine particles, there are preferably used various carbon blacks such as furnace and channel black, especially Corax L (electrically conductive carbon black manufactured by Degussa Co.) and Vulcan XC-72R (carbon black manufactured by Cabot Co.). Suitable examples of electrically conductive fine particles are described in detail in our Japanese Patent Application Laid-Open Specification No. 88227/76 and U.S. application Ser. No. 732,759.

The fine particles may be dry-blended in an amount of 0.001 to 2% by weight, especially 0.1 to 1.0% by weight, based on the magneto-sensitive particles. The dry blending can be carried out by using an ordinary dry blender or tube mill. If necessary, the dry blending can be conducted in the presence of a mixing medium such as glass beads.

The developer formed by this dry blending operation is applied to the intended use as it is or after it has been classified by sieving according to need.

In general, the developer of the present invention has a relatively low electric resistance in the range of from $10^6$ to $10^{12}$-cm. As will readily be understood from the fact that the angle of repose of the developer of the present invention is in the range of 10° to 70°, especially 30° to 60°, the developer of the present invention has a very excellent flowability. Further, as is seen from the fact that the cohesion ratio (Rc), represented by the following formula, of the developer of the present invention is lower than 10%, especially lower than 5%, the tendency of agglomeration or cohesion of the developer particles is remarkably reduced:

$$Rc = \frac{X}{Xo} \times 100$$

wherein Xo stands for the weight (g) of the developer particles which pass through a 200-mesh sieve, and X stands for the weight (g) of the developer particles left on the 200-mesh sieve after the developer particles which have passed through the 200-mesh sieve are heated at 50° C. for 60 minutes.

The developer of the present invention can be advantageously used for developing static images according to the magnetic brush method, and developed images having high contrast and density and being free of blurring of image contours can be formed without occurrence of such troubles as contamination of an optical system with carbon scattered from the developing zone and contamination of the background of a photosensitive plate.

An image of the developer particles formed by the development is fixed under application of pressure or heat as it is or after it has been transferred onto a transfer sheet. A pair of pressing metal rolls can be used for pressure fixation, and a polytetrafluoroethylene-coated roller having a heating mechanism installed in the inerior thereof can be used for heat fixation. In each case, a fixed image excellent in the friction resistance, namely a fixed image in which fine particles of carbon black or the like are not separated by friction, can be obtained. In general, heat fixation may be carried out at temperatures within a relatively broad range of 140° to 200° C. and pressure fixation can be accomplished under a linear pressure (roller pressure) of 200 to 500 Kg/cm, though these temperature and pressure conditions vary to some extent depending on the kind of the binder contained in the developer. Further, in each case, occurrence of the offset phenomenon can be prevented. This is another advantage.

The present invention will now be described in detail by reference to the following Examples that by no means limit the scope of the invention.

EXAMPLE 1

| | |
|---|---|
| Acrylic resin (Dianearl BR-83 manufactured by Mitsubishi Rayon) | 16 parts by weight |
| Butyral resin (Slec BL-1 manufactured by Sekisui Kagaku) | 13 parts by weight |
| Low-molecular-weight polyolefin (Sanwax 171P manufactured by Sanyo Kasei) | 12 parts by weight |
| $Fe_3O_4$ (Synthetic Tetsuguro B6 manufactured by Toyo Shikiso) | 55 parts by weight |
| Carbon black (Corax L manufactured by Degussa Co.) | 4 parts by weight |

A composition comprising the above ingredients was pulverized and mixed, and was then molten and kneaded at a temperature of 150° C. by a heated three-roll mill. The kneaded composition was cooled and solidified, and then was pulverized by a pulverizer. Then, 100 parts by weight of the so prepared particles were dry-blended with 0.8 part by weight of carbon black (Corax L manufactured by Degussa Co.) together with 50 parts by weight of glass beads, and the glass beads were removed from the dry blend. Then, the dry blend was treated by a classifier to obtain a developer having a particle size of 5 to 50μ. By using the so prepared developer, prints were prepared by conducting development and fixation in an electrophotographic copying machine provided with a Teflon-coated fixing roller (Denshi Copystar 700D manufactured by Mita Industrial Co.). No contamination of the background was observed in the prints, and the prints had a very clear and sharp image having a high density. In the obtained prints, flow or blurring of the images was not caused by friction. When 1000 prints were obtained by conducting the copying operation continuously, it was found that the the interior of the copying machine was not contaminated at all. Occurrence of the offset phenomenon was not observed.

EXAMPLE 2

| | |
|---|---|
| Styrene-acrylic resin (Pliolite AC-L manufactured by Goodyear Co.) | 15 parts by weight |
| Epoxy resin (Epikote 1004 manufactured by Shell Chemical Co.) | 13 parts by weight |
| Low-molecular-weight polyolefin (Hiwax 210P manufactured by Mitsui Sekiyu Co.) | 7 parts by weight |
| $Fe_3O_4$ (BL-500 manufactured by Titanium Kogyo Co.) | 58 parts by weight |
| Carbon black (XC-72 manufactured by Cabot Co.) | 5 parts by weight |

A composition comprising the above ingredients was sufficiently kneaded in a heating kneader, and the kneaded composition was taken out from the kneader, cooled, solidified, roughly pulverized and finely pulverized by a pin mill. Then, 100 parts by weight of the so prepared particles were sufficiently dry-blended with 0.8 part by weight of carbon black (XC-72 manufactured by Cabot Co.) by means of a V-shaped blender and the dry blend was classified by an air classifier to prepare a developer having a particle size of 5 to 50μ. By using the so prepared developer, prints were obtained in an electrophotographic copying machine (Denshi Copystar 700D). In each print, contamination of the background was not observed, and the obtained image was clear and sharp and had a high density. When 1000 prints were continuously prepared, the interior of the copying machine was not contaminated at all.

EXAMPLE 3

| | |
|---|---|
| Styrene resin (Piccolastic D-125 manufactured by Pennsylvania Chemical Co.) | 20 parts by weight |
| Polyester resin (Vylon GV manufactured by Toyobo) | 10 parts by weight |
| Low-molecular-weight polyolefin (PA-510 manufactured by Hoechst AG) | 8 parts by weight |
| $\gamma$-$Fe_2O_3$ (MRM-B-450 manufactured by Toda Kogyo) | 60 parts by weight |
| Carbon black (#30 manufactured by Mitsubishi Kasei) | 4 parts by weight |

A developer having a particle size of 5 to 50μ was prepared by treating a composition comprising the above ingredients in the same manner as described in Example 1. In prints prepared in an electrophotographic copying machine (Denshi Copystar 700D) by using the so prepared developer, contamination of the background was not observed and the image was clear and sharp and had a high density. Flow of the image was not caused even by friction. When 1000 prints were continuously prepared, the interior of the copying machine was not contaminated at all.

EXAMPLE 4

| | |
|---|---|
| Styrene-butadiene copolymer (Pliolite S-5B manufactured by Goodyear Co.) | 12 parts by weight |
| Styrene-olefin copolymer (Klyrvel 90 manufactured by Velsicol Chemical Co.) | 5 parts by weight |
| Rosin-modified maleic acid resin (Teskit manufactured by Tokushima Seiyu Co.) | 5 parts by weight |
| Low-molecular-weight polyolefin (AC Polyethylene 6A manufactured by Allied Chemical Co.) | 10 parts by weight |
| $\gamma$-$Fe_2O_3$ (FX-6410-B manufactured by Toda Kogyo) | 65 parts by weight |
| Carbon black (Reagal 300R manufactured by Cabot Co.) | 5 parts by weight |

A composition comprising the above ingredients was sufficiently molten and kneaded by a heated three-roll mill, cooled and solidified, and finely pulverized by a pulverizer, and a developer having a particle size classified to 5 to 25μ was prepared by treating the so prepared particles in the same manner as described in Example 2. A ZnO photosensitive plate was charged at −5 KV, exposed to light and developed by using the so prepared developer. Then, a plain transfer paper was piled on the photosensitive plate and charged with the same polarity, and the transfer paper was taken out and passed through between heating fixing rolls to effect fixation. The obtained copy had a very high-density image with a very high transfer efficiency, which had a high contrast and was clear and sharp. Contamination of the background was not observed at all.

When 1000 prints were continuously prepared, mirrors, lenses and other members in a copying machine were not contaminated at all, although the particles of the developer were very small.

EXAMPLE 5

| | |
|---|---|
| Vinyltoluene resin (Pliolite VT manufactured by Goodyear Co.) | 13 parts by weight |
| Terpene-phenolic resin (YS Polyster T-100 manufactured by Yasuhara Yushi Co.) | 8 parts by weight |
| Low-molecular-weight polyolefin (Biscol 550-P Sanyo Kasei) | 10 parts by weight |
| $\gamma$-$Fe_2O_3$ (manufactured by Titanium Kogyo Co.) | 65 parts by weight |
| Carbon black (manufactured by Degussa Co.) | 5 parts by weight |

A developer was prepared by treating a composition comprising the above ingredients in the same manner as described in Example 4. An Se photosensitive plate was charged at +5 KV, exposed to light and developed by using the prepared developer, and a transfer paper was piled on the photosensitive plate and charged to effect image transfer. The transferred image was fixed by a Teflon-coated roller. The obtained image was clear and sharp and had a high density. Contamination of the background was not observed. Flow of the image was not caused by friction. When 1000 prints were continuously prepared, the interior of a copying machine was not contaminated at all.

EXAMPLE 6

By using the developer prepared in Example 4, development was conducted and the developed image on a phthalocyanine compound photosensitive plate was transferred onto a transfer paper and fixed. The obtained print was free from contamination of the background and the transferred and fixed image was clear and sharp and had high density and contrast. Further, the fixed image had a high resistance to friction. When the copying operation was conducted continuously, the interior of a copying machine was not contaminated at all.

EXAMPLE 7

By using the developer prepared in Example 4, development was conducted and the developed image on a polyvinyl carbazole photosensitive plate was transferred onto a transfer paper and fixed. The obtained print was free from contamination of the background and the transferred and fixed image was clear and sharp and had a high contrast. The fixed image had a high resistance to friction and flow or blurring of the image was not caused by friction.

COMPARATIVE EXAMPLE 1

Particles were prepared in the same manner as in Example 1 except that the low-molecular-weight polyolefin was not incorporated into the starting composition, and these particles were dry-blended with 0.8% by weight of carbon black. A developer prepared from this dry blend was compared with the developer of the present invention (Example 2).

COMPARATIVE EXAMPLE 2

Particles were prepared from the starting composition used in Example 2, but they were not dry-blended with carbon black at all. The resulting developer was compared with the developer of the present invention (Example 2).

COMPARATIVE EXAMPLE 3

The starting composition used in Example 2 was not molten or kneaded but was dissolved and dispersed in 700 ml of a 50/50 mixed solvent of toluene/methylethyl ketone, and the resulting liquid composition was spray-dried at a drying temperature of 150° C. by using a spray gun to prepare particles having a particle size of 5 to 50μ. The resulting particles were treated in the same manner as described in Example 2. The resulting developer was compared with the developer of the present invention.

Results of comparison are shown in Table 1.

In Table 1, the respective properties were evaluated based on the naked eye observation according to the following scale.

○ : practically satisfactory

X: practically not satisfactory

TABLE 1

| | Developer of Present Invention (Example 2) | Developer of Comparative Example 1 | Developer of Comparative Example 2 | Developer of Comparative Example 3 |
|---|---|---|---|---|
| Appearance | amorphous | amorphous | amorphous | spherical |
| Repose Angle (°) | 32 | 30 | 39 | 29 |
| Volume Resistivity (Ω-cm) | $5.3 \times 10^8$ | $6.8 \times 10^6$ | $1.1 \times 10^{14}$ | $6.7 \times 10^7$ |
| Image Density | ○ | ○ | X | ○ |
| Edge Effect, Scattering | ○ | ○ | X | ○ |
| Contamination of Background | ○ | X | X | ○ |
| Fixing Property | ○ | X | ○ | X |
| Offset Resistance | ○ | X | X | X |
| Friction Resistance | ○ | X | ○ | X |
| Contamination of Interior of Copying Machine after Preparation of 1000 Prints | ○ | X | X | X |

What we claim is:

1. A developer for electrophotography consisting essentially of a dry blend of fixing magneto-sensitive particles having a particle size of 5 to 50μ and flowability and electric resistance-controlling fine particles having particle size of up to 1 micron in an amount of 0.001 to 2 parts by weight per 100 parts by weight of said fixing magneto-sensitive particles, wherein said fixing magneto-sensitive particles are obtained by kneading a composition comprising (A) $Fe_3O_4$ or $\gamma$-$Fe_2O_3$, (B) carbon black, (C) a binder resin composed mainly of at least one resin selected from the group consisting of aromatic vinyl resins and acrylic resins and (D) a low-molecular-weight olefin resin at an (A):(B):(C):(D) mixing weight ratio of (20–80):(0.5–20):(18–40):(0.5–30), cooling the kneaded composition and pulverizing the cooled composition and said flowability-and electric resistance-controlling fine particles are adhering to and held on the surfaces of said fixing magneto-sensitive particles substantially inseparably therefrom wherein said binder resin (C) is present in the fixing magneto-sensitive particles in the form of a continuous phase and said low-molecular-weight olefin resin (D) is present in the fixing magneto-sensitive particles in the form of a dispersed phase together with $Fe_3O_4$ or $\gamma$-$Fe_2O_3$ (A) and carbon black (B).

2. A developer as set forth in claim 1 which has an electric resistance of $10^6$ to $10^{12}$Ω-cm, an angle of repose of 30° to 60° and a cohesion ratio lower than 5%.

3. A developer as set forth in claim 1 wherein said olefin resin has a weight average molecular weight of from 1,000 to about 10,000 and a softening point of 80° to 160° C.

4. A developer as set forth in claim 1 wherein said flowability and electric resistance-controlling fine particles are composed of carbon black.

5. A developer for electrophotography consisting essentially of a dry blend of fixing magneto-sensitive particles having a particle size of 5 to 50μ and fine carbon black particles having a particle size of up to 1μ in an amount of 0.001 to 2 parts by weight per 100 parts by weight of said fixing magneto-sensitive particles, wherein said fixing magneto-sensitive particles are obtained by kneading a composition comprising (A) $Fe_3O_4$ or $\gamma$-$Fe_2O_3$, (B) carbon black, (C) a binder resin composed mainly of at least one resin selected from the group consisting of aromatic vinyl resins and acrylic resins and (D) an olefin resin having a weight average molecular weight of 1,000 to 10,000 and a softening point of 80° to 160° C. at an (A):(B):(C):(D) mixing weight ratio of (20–80):(0.5–20):(18–40):(0.5–30), cooling the kneaded composition and pulverizing the cooled composition and said fine particles are adhering to and held on the surfaces of said fixing magneto-sensitive particles substantially inseparably therefrom wherein said binder resin (C) is present in the fixing magneto-sensitive particles in the form of a continuous phase and said low-molecular-weight olefin resin (D) is present in the fixing magneto-sensitive particles in the form of a dispersed phase together with $Fe_3O_4$ or $\gamma$-$Fe_2O_3$ (A) and carbon black (B).

6. A carrierless developer for electrophotography consisting essentially of a dry blend of fixing magneto-sensitive particles having a particle size of 5 to 50 microns and flowability-and electric resistance-controlling fine particles having a particle size of up to 1 micron adhered to and held on the surface of said fixing magneto-sensitive particles substantially inseparably therefrom, but without being embedded in said fixing magneto-sensitive particles, the amount of said fine particles being from about 0.001 to 2 parts by weight per 100 parts by weight of said fixing magneto-sensitive particles, said fixing magneto-sensitive particles comprising (A) $Fe_3O_4$ or $\gamma$-$Fe_2O_3$, (B) carbon black, (C) a binder resin composed mainly of at least one resin selected from the group consisting of aromatic vinyl resins and acrylic resin and (D) a low-molecular-weight olefin resin at an (A):(B):(C):(D) mixing weight ratio of (20–80):(0.5–20):(18–40):(0.5–30), wherein said binder resin (C) is present in the fixing magneto-sensitive particles in the form of a continuous phase and said low-molecular-weight olefin resin (D) is present in the fixing magneto-sensitive particles in the form of a dispersed phase together with $Fe_3O_4$ or $\gamma$-$Fe_2O_3$ (A) and carbon black (B).

7. A developer as set forth in claim 6 which has an electric resistance of $10^6$ to $10^{12}$ Ω-cm, an angle of repose of 30° to 60° and a cohesion ratio lower than 5%.

8. A developer as set forth in claim 7 wherein said olefin resin has a weight average molecular weight of about 1,000 to about 10,000 and a softening point of 80° to 160° C.

9. A developer as set forth in claim 8 wherein said flowability and electric resistance-controlling fine particles are composed of carbon black.

10. A developer as set forth in claim 9 wherein the (A):(B):(C):(D) mixing weight ratio is (40–75):(1–10):(20–35):(1–15).

11. A developer as set forth in claim 10 wherein said aromatic vinyl resin is a homopolymer or copolymer of a monomer represented by the formula:

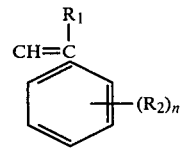

wherein $R_1$ stands for a hydrogen atom or a lower alkyl group, $R_2$ stands for a lower alkyl group, a lower alkoxy group, a nitro group, an amino group, a halogen atom or other substituent, and n is 0 or an integer of 1 or 2.

12. A developer as set forth in claim 10 wherein said binder resin (C) has a molecular weight in the range of 500 to 75,000.

13. A developer as set forth in claim 12 wherein said binder resin (C) has a molecular weight in the range of 1,000 to 30,000.

14. A developer as set forth in claim 13 wherein the amount of the fine carbon black particles range from about 0.1 to 1.0 percent by weight, based on the magneto-sensitive particles.

* * * * *